US005694803A

United States Patent [19]

Ervin et al.

[11] Patent Number: 5,694,803

[45] Date of Patent: Dec. 9, 1997

[54] FIN FOLDING MACHINE FOR CORRUGATING SHEET MATERIAL

[75] Inventors: Douglas R. Ervin, Metamora; Clifford G. Knepper, Astoria; Thomas J. Quinn, Morton, all of Ill.

[73] Assignee: Solar Turbines Incorporated, San Diego, Calif.

[21] Appl. No.: 346,657

[22] Filed: Nov. 30, 1994

[51] Int. Cl.[6] ..... B21D 13/02

[52] U.S. Cl. ..... 72/385; 72/379.6; 72/20.1

[58] Field of Search ..... 72/383, 385, 379.6, 72/20.1

[56] References Cited

U.S. PATENT DOCUMENTS

| | | | |
|---|---|---|---|
| 951,630 | 3/1910 | Cooley . | |
| 2,290,608 | 7/1942 | Evans | 154/30 |
| 3,009,510 | 11/1961 | Meshulam | 153/76 |
| 3,307,387 | 3/1967 | Lacey, Jr. et al. | 72/324 |
| 3,479,855 | 11/1969 | Ogilvie | 72/383 |
| 3,511,073 | 5/1970 | Williamson | 72/384 |
| 3,641,803 | 2/1972 | Schuurbiers | 72/381 |
| 3,748,889 | 7/1973 | Miller et al. | 72/382 |
| 3,760,624 | 9/1973 | Robinson | 72/385 |
| 3,845,654 | 11/1974 | Fuller et al. | 72/381 |
| 3,892,119 | 7/1975 | Miller et al. | 72/385 |
| 4,022,050 | 5/1977 | Davis et al. | 72/379 |
| 4,275,581 | 6/1981 | Miller | 72/385 |
| 4,736,518 | 4/1988 | Golden et al. | 72/385 |

FOREIGN PATENT DOCUMENTS

| | | | |
|---|---|---|---|
| 951206 | 10/1956 | Germany | 72/385 |
| 57133 | 10/1936 | Norway | 72/385 |
| 547261 | 2/1977 | U.S.S.R. | 72/385 |
| 584575 | 1/1947 | United Kingdom . | |
| 604738 | 7/1948 | United Kingdom . | |
| 890685 | 3/1962 | United Kingdom . | |
| 919724 | 2/1963 | United Kingdom . | |
| 1028091 | 5/1966 | United Kingdom . | |
| 1296266 | 11/1972 | United Kingdom . | |

*Primary Examiner*—David Jones
*Attorney, Agent, or Firm*—O. Gordon Pence

[57] ABSTRACT

A fin folding machine is disclosed for sequentially folding relatively thin sheet metal material into narrowly grooved corrugations. The fin folding machine includes a pair of opposed clamping tools disposed on opposite sides of the sheet material. The clamping tools are movable in a direction transverse to and into engagement with the sheet material to clamp the sheet material therebetween. A pair of opposed forming tools are disposed on opposite sides of the sheet material and are sequentially movable in a direction transverse to and into engagement with the sheet material to fold the sheet material in one direction by the engagement of one of the forming tools and then in the opposite direction by the engagement of the other of the forming tools. Gas charged accumulators are used to apply a force to continuously urge a respective one of the clamping and forming tools into engagement with the sheet material. Camming devices are used to move a respective one of the clamping and forming tools away from engagement with the sheet material to a clearance position, and to prevent its respective clamping or forming tool from exceeding a predetermined material engagement stop position regardless of the operating speed of the fin folding machine.

15 Claims, 8 Drawing Sheets

28
10
20
96
98
94
100
100
48
112
122
24
170
112
48
126
22
36
32
224
14
226
18
38
34
12
128
168
48
124
112
26
48
101
101
98
96
30

14
12
32
22
44
38
42
34
48
40
146
144
134
126
124
128
112
136
36

FIN FOLDING MACHINE FOR CORRUGATING SHEET MATERIAL

TECHNICAL FIELD

This invention relates generally to apparatus for corrugating sheet material for use in heat exchangers or recuperators and, more particularly, to an improved fin folding machine with mechanically actuated forming and clamping members capable of increased forming speed.

BACKGROUND ART

Apparatus for corrugating sheet material for use as the primary surface plates of heat exchangers or recuperators for gas turbine engines and the like are known in the art. In one technique, as disclosed in U.S. Pat. No. 3,892,119, by Kenneth J. Miller et.al., issued Jul. 1, 1975, corrugating apparatus sequentially folds relatively thin sheet material into closely spaced, deeply drawn serpentine convolutions. Such apparatus can produce about 40 fins per inch with a height of about 3.175 mm (0.125 inches), thus providing a large surface area that is essential for high capacity heat exchangers. However, this apparatus uses opposed forming members that are powered by hydraulic cylinders. In addition, the forming members are carried on relatively massive pivotally mounted shoes. While the apparatus works quite well at slower speeds, it can not be run satisfactorily at a speed exceeding more than 150 cycles per minute. Above this limit, the forming members tend to overshoot their desired depth of formation positions, even with the use of mechanical stops. Thus, precise fin height is lost and the thin sheet material may be over stressed, causing tears or other failures.

The present invention is directed to overcoming the shortcomings of prior fin folding machines by providing a fin folding machine that is capable of forming thin sheet material into high aspect ratio serpentine corrugations at a more productive operating speed.

DISCLOSURE OF THE INVENTION

In accordance with one aspect of the present invention, a fin folding machine is provided for sequentially folding relatively thin sheet metal material into narrowly grooved corrugations. The fin folding machine includes a pair of opposed clamping tools disposed on opposite sides of the sheet material. The clamping tools are movable in a direction transverse to and into engagement with the sheet material to clamp the sheet material therebetween. A pair of opposed forming tools are disposed on opposite sides of the sheet material and are sequentially movable in a direction transverse to and into engagement with the sheet material to fold the sheet material in one direction by the engagement of one of the forming tools and then in the opposite direction by the engagement of the other of the forming tools. At least four accumulators are included, each of which is adapted to apply a force to continuously urge a respective one of the clamping and forming tools into engagement with the sheet material. At least four camming devices are also included, each being adapted to move a respective one of the clamping and forming tools away from engagement with the sheet material to a clearance position, and to prevent its respective clamping or forming tool from exceeding a predetermined material engagement stop position regardless of the operating speed of the fin folding machine.

BEST MODE FOR CARRYING OUT THE INVENTION

Figure 1:
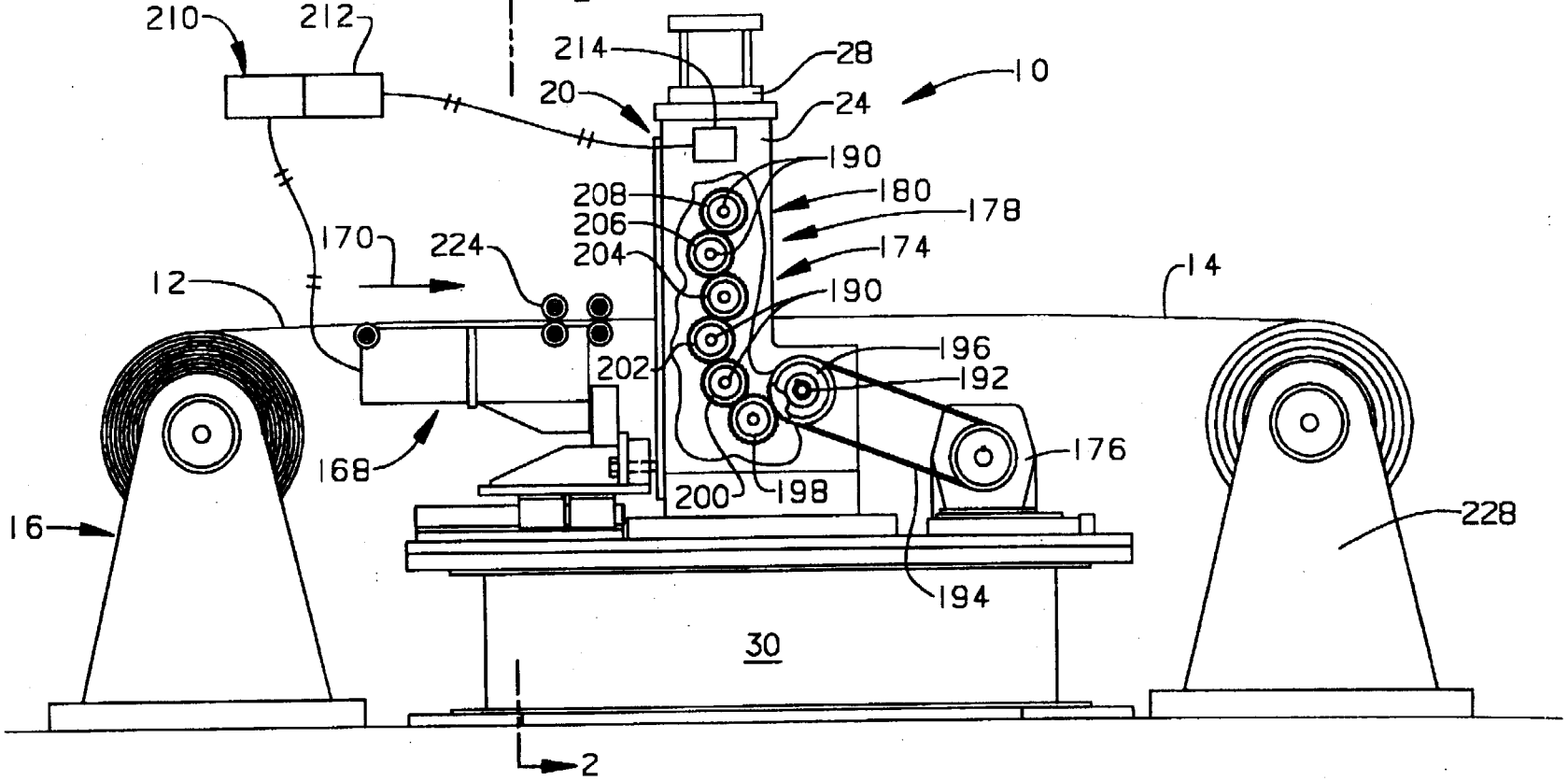
FIG. 1 is a diagrammatic side elevational view of a fin folding machine embodying the principles of the present invention in association with a material feeder for thin sheet material and in which a portion of an upright side support for the machine has been broken away to disclose the drive system.
Figure 2:
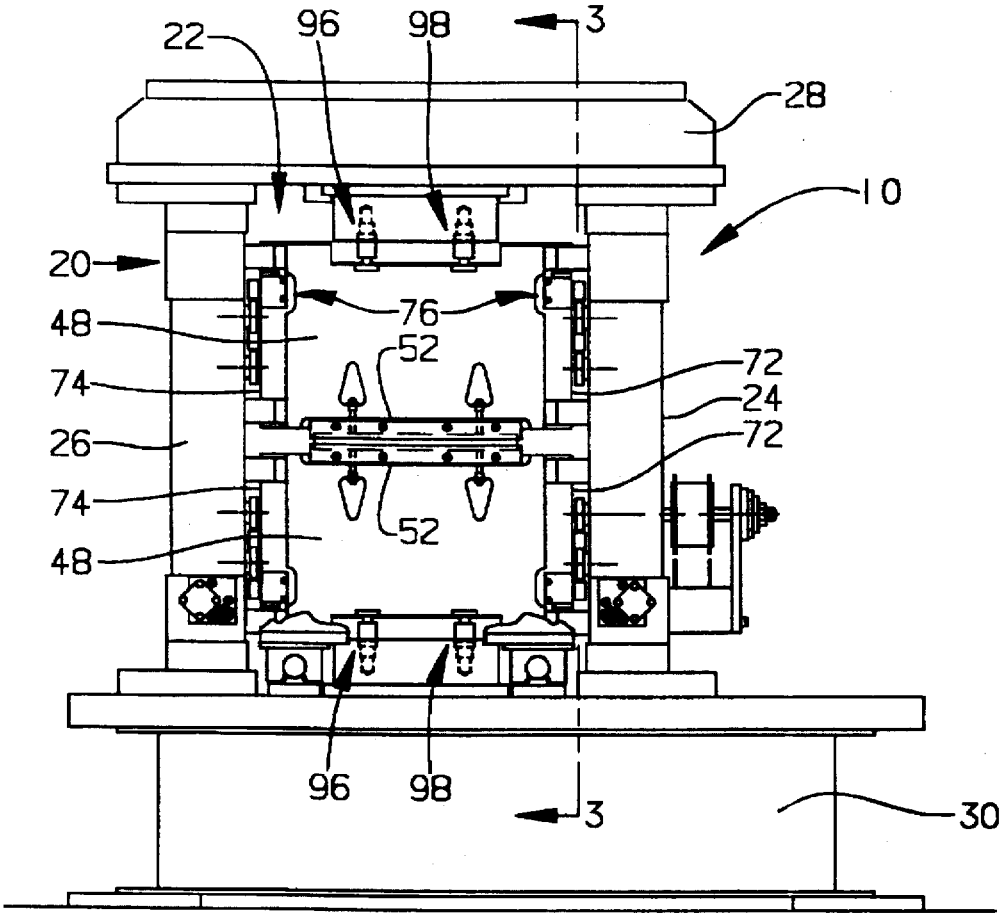
FIG. 2 is a diagrammatic end elevational view of the fin folding machine as viewed in the direction of the arrows 2—2 in FIG. 1 and in which, for clarity, the material feeder has been removed.
Figure 3:
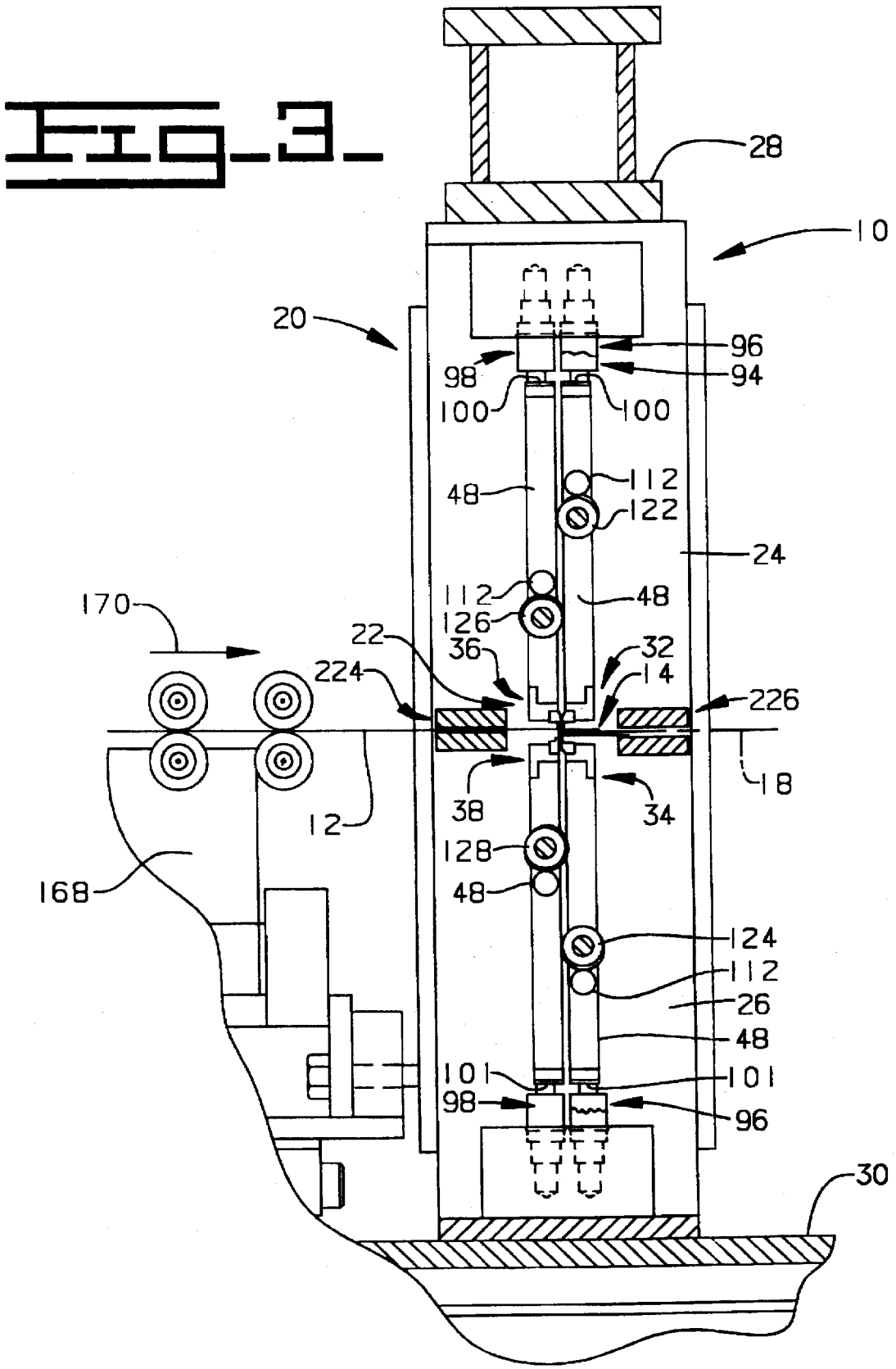
FIG. 3 is a diagrammatic enlarged fragmentary sectional view of one of the side support members illustrating the clamping and forming members and their connection to the accumulator system as viewed in the direction of the arrows 3—3 in FIG. 2.
Figure 5:
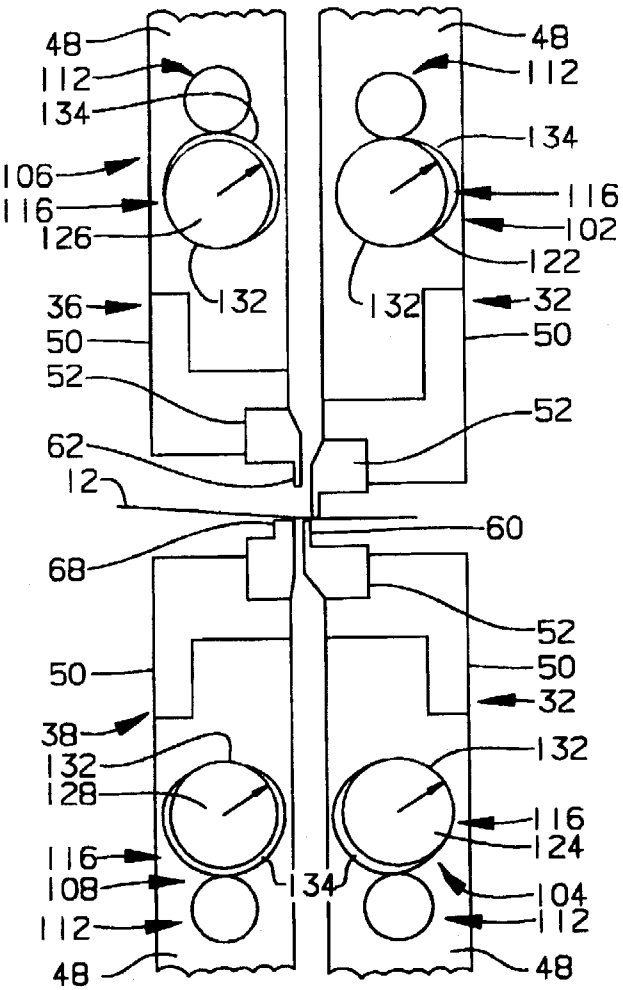
FIG. 4–8 are diagrammatic side views illustrating the various sequential positions of the clamping and forming members during operation from their fully opened position illustrated in FIG. 4 to their fully closed position illustrated in FIG.8.

Referring more particularly to the drawings, a fin folding machine embodying the principles of the present invention is generally indicated at 10 in FIGS. 1 and 2. The fin folding machine 10 is for use in sequentially folding substantially flat, relatively thin sheet material, indicated at 12, into a narrowly grooved corrugated configuration 14, as best seen in FIGS. 3–8 and 12, by sequential single-fold forming steps which will hereinafter be described. The sheet material 12 is preferably stainless steel having a thickness of approximately 0.8 mm (0.003 inches). Such stainless steel sheet material 12 is commonly commercially available in large rolls of 304.8 mm (12 inches) wide material. Such rolls may be supported on a free wheeling delivery reel stand 16 for delivery to the machine 10 along a generally horizontally disposed path 18 (FIG. 3).

As best shown in FIG. 2, the fin folding machine 10 includes a frame structure 20 having an opening 22 therethrough defined by a pair of upright side support members 24, 26, a top support member 28 between the upper ends of the side support members 24, and a base support member 30 between the lower ends of the side support members 24, 26.

To sequentially fold the relatively thin sheet metal material 12 into the narrowly grooved corrugations 14, the fin folding machine 10 includes a pair of opposed upper and lower clamping tools 32, 34, as shown in FIG.3, which are disposed on opposite sides of the sheet material 12, and a pair of upper and lower opposed forming tools 36, 38, which are also disposed on opposite sides of the sheet material 12. The clamping tools 32, 34 are movable in a direction transverse to and into engagement with the sheet material 12 to clamp the sheet material therebetween. The forming tools 36, 38 are similarly sequentially movable in a direction transverse to and into engagement with the sheet material 12 to fold the sheet material in one direction by the engagement of the first forming tool 36 and then in the opposite direction by the engagement of the second forming tool 38.

Figure 12:
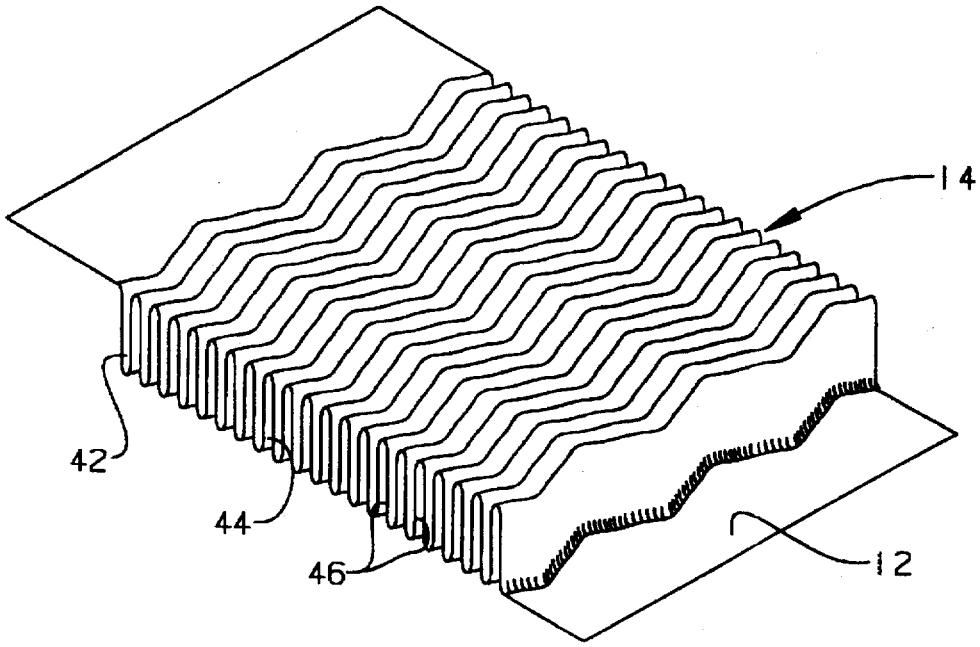
FIG. 12 is a diagrammatic isometric view of a formed corrugation produced by the fin folding machine utilizing the principles of the subject invention.

After transformation, as best shown in FIG. 12, the corrugated material 14 includes a plurality of alternating upwardly and downwardly opening, transversely extending, relatively deep serpentine grooves 42 and 44 having relatively closely spaced, substantially vertical sidewalls or fins 46 as they are commonly called.

Figure 4:
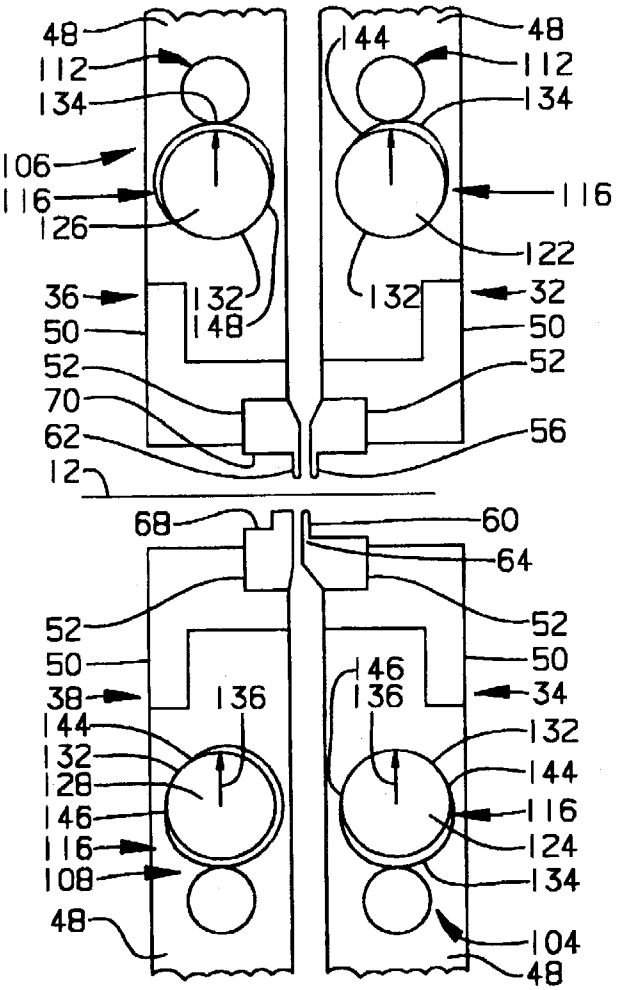
Figures 6, 7, 8:
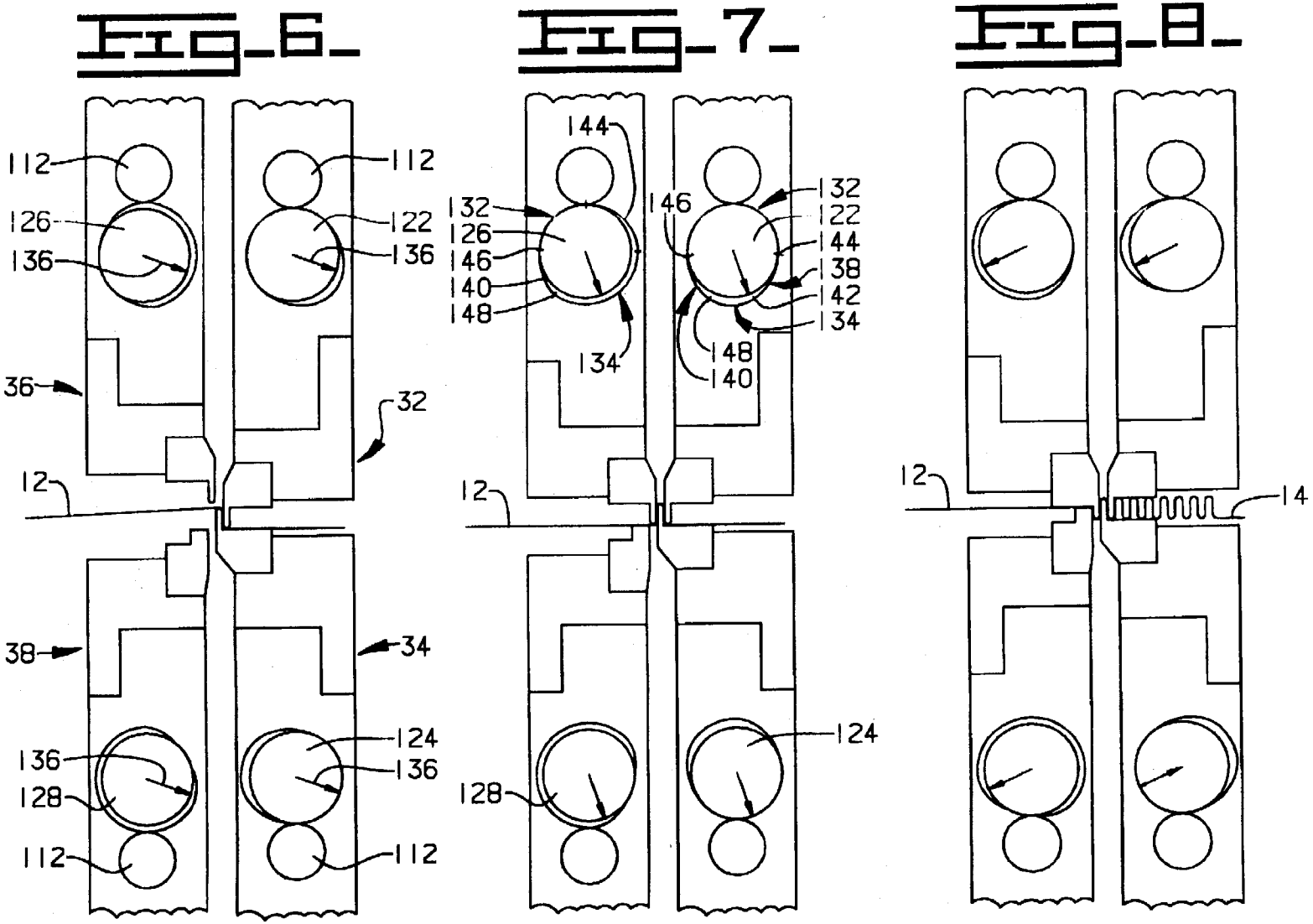

Each of the clamping and forming tools 32, 34, 36, 38, as best shown in FIGS. 4–8 and 11, includes an elongated plate 48, a tool holder 50 attached to one end of its respective plate 48, and a tool 52 attached to the tool holder 50. The tool 52 of the first or upper clamping tool 32 is provided with a downwardly extending serpentine knife blade portion 56 (FIG.4). Such blade portion 56 is configured to be received into the last to be formed upwardly opening groove 42. The tool 52 of the second or lower clamping tool 34 is provided with an upwardly extending serpentine knife blade portion 60 that is configured to be received against the last fin 46 to be formed of the last formed groove 42 and in a closely spaced offset and mating relation to the blade portion 56 of the first clamping tool 32 so as to clamp the material 12 therebetween during the forming operation. The tool 52 of the first or upper forming tool 36 has a similar knife blade portion 62, while the tool 52 of the second or lower forming tool 38 is provided with a serpentine die forming side surface 64 and a substantially flat distal end surface 68. The distal end surface 68 and an opposed end surface 70 formed on the upper forming tool 36 cooperate to flatten or de-wrinkle the sheet material 12 adjacent the last formed fin 46 as shown in FIG. 8.

Figure 10:
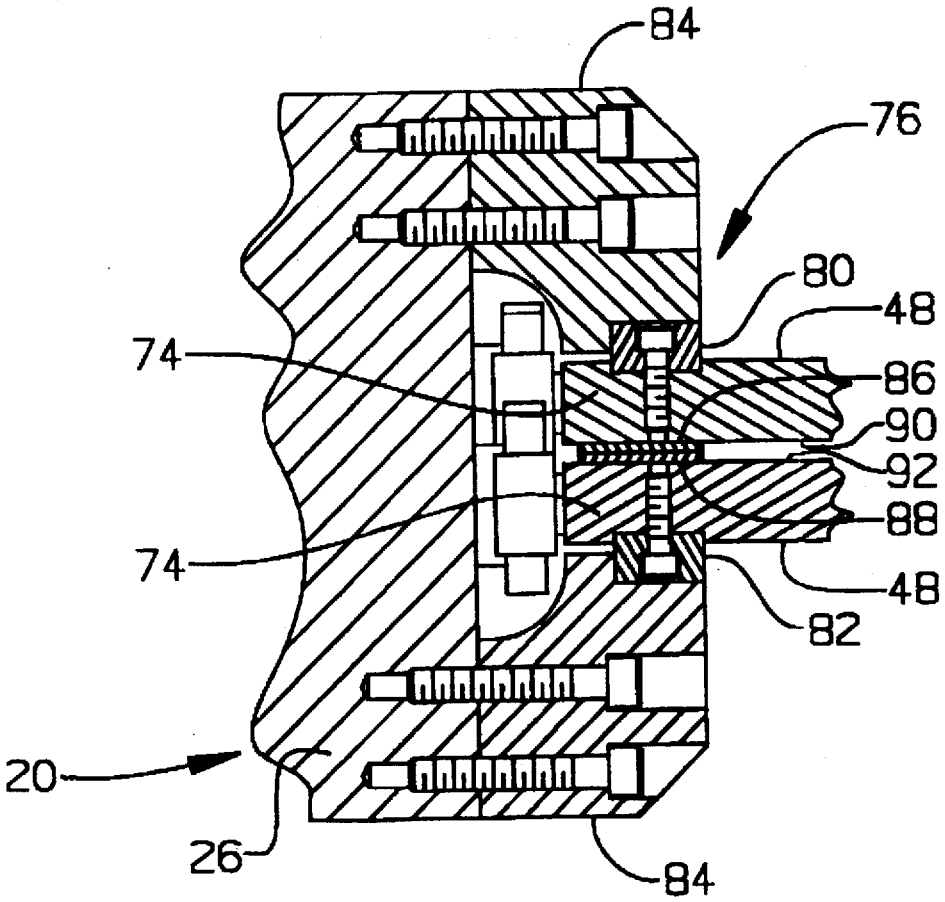
FIG. 10 is a diagrammatic fragmentary sectional view of the linear bearings for orientation and guiding of the elongate plates of the clamping and forming tools.
Figure 11:
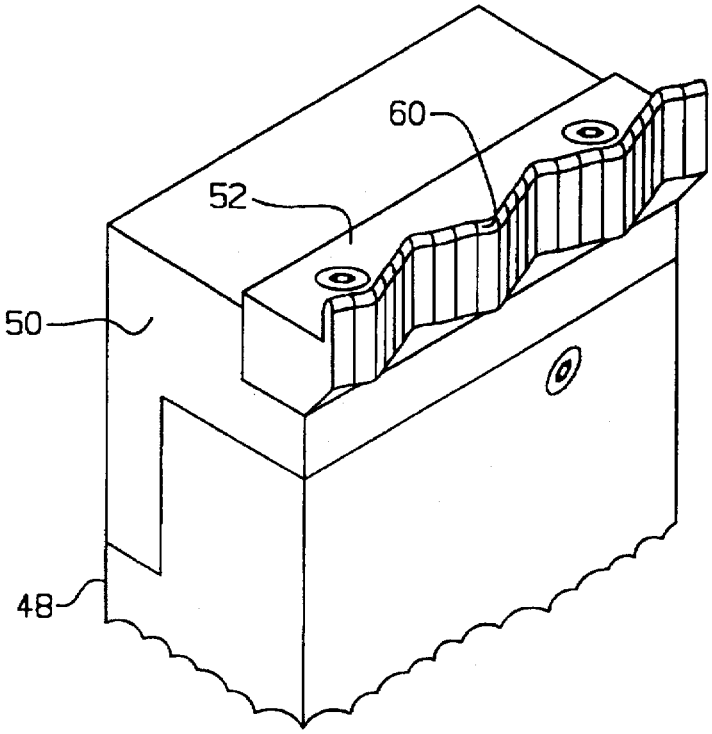
FIG. 11 is a diagrammatic enlarged fragmentary isometric view illustrating the general construction of one of the forming members of the present invention.

As shown in FIGS. 2 and 10, each of the elongated plates 48 are oriented transversely between the side support members 24, 26 of the frame structure 20 and each has a first end 72 adjacent one of the side support members 24 and a second opposite end 74 adjacent the other of the side support members 26. Linear bearing means 76 are provided for reciprocatably mounting each of the elongated plates 48 to the frame structure 20 for movement of each plate 48 along a linear path transverse to the sheet material 12. Such bearing means 76 preferably includes a pair of vertically aligned bearing sets 80, 82, each carried adjacent one of the ends 72, 74 of a respective one of the four elongated plates 48. Each bearing 80, 82 is disposed in slidable bearing contact with and is guided by a bracket 84 that is attached to a respective one of the uprights side supports 24, 26 of the frame structure 20. Bearing means 76 also includes appropriate sets of mating linear bearings 86, 88 carried on a respective one of first and second sides 90, 92 of the four elongated plates 48, and in facing relationship to each other, the bearings 86 on one such plate 48 being in slidable bearing contact with the bearing 88 of the facing plate 48. Such bearings 80, 82, 86, 88 may be made of any suitable anti-friction material, such as bronze.

As illustrated in FIGS. 2 and 3, the fin folding machine 10 also includes an accumulator system 94 for applying a substantially continuous force on each of the clamping and forming tools 32, 34, 36, and 38 to urge each of the tools into engagement with the sheet material 12. The accumulator system 94 preferably includes a pair of nitrogen gas cylinders 96, 98 for each of the clamping and forming tools 32, 34, 36, and 38. Each of the upper elongated plates 48 of the clamping and forming tools 32 and 36 have a top end 100 adjacent the top support member 28, while each of the lower plates 48 of the clamping and forming tools 34 and 38 have a bottom end 101 adjacent the base support member 30. Each pair of gas cylinders 96, 98 are mounted between a respective one of the top support member 28 and the base support member 30 and an adjacent end 100, 101 of their respective elongated plates 48. Each gas cylinder 96, 98 is charged with a substantial gas pressure sufficient to cause the clamping tools 32, 34 to clamp the sheet material 12 therebetween and each of the forming tools 32, 34 to fold such sheet material. Nitrogen gas cylinders 96, 98 with a gas charge pressure of approximately 103,350 kPa (15,000 p.s.i.) have been found to be suitable.

As best shown in FIGS. 4–8, two sets of four camming devices 102, 104, 106, and 108 are provided to overcome the accumulator force of cylinders 96, 98 and to move a respective one of the clamping and forming tools 32, 34, 36, and 38 away from engagement with the sheet material 12 to a clearance position shown in FIG. 4. It should be noted that the set of camming devices shown in FIGS. 4–8 are at one end 72 of the elongated plates 48. A matching set of cams are located at the other end 74 of the elongated plates, but as they are the mirror image of the first set, they are not shown in the drawings.

Each of the camming devices 102, 104, 106, and 108 is also adapted to prevent its respective clamping or forming tool 32, 34, 36, or 38 from exceeding a predetermined sheet material engagement stop position regardless of the operating speed of the fin folding machine. To accomplish this, each set of the camming devices 102, 104, 106, and 108 includes a pair of cam followers, only one of which is shown at 112 in FIG. 4–8, and an associated pair of cams, one of which is shown at 116, for each of the clamping tools 32, 34 and the forming tools 36, 38. A respective one of the pair of cam followers 112 is rotatably carried on one of the opposite ends 72, 74 of each of the elongated plates 48. Each cam 116 is rotatably carried on an adjacent one of the side support members 24 or 26.

In particular, each of the pairs of cams 116 includes a first pair of cams, one of which is shown at 122, for operating the first one of the clamping tools 32, a second pair of cams, one of which is shown at 124, for operating the second one of the clamping tools 34, a third pair of cams, one of which is shown at 126, for operating the first one of the forming tools 36, and a fourth pair of cams, one of which is shown at 128, for operating the second one of the forming tools 38. Each of the cams 122, 124, 126, and 128 is provided with a different predetermined profile, with each having a full null portion at 132 and a full lifting lobe portion at 134 thereon. Each full lifting lobe portion 134 is adapted to lift its respective tool 32, 34, 36, and 38 to the sheet material clearance position shown in FIG. 4, while the full null portion 132 is adapted to permit its respective tool to assume its predetermined sheet material engagement stop position as shown in FIG. 8. The cams 122, 124, 126, and 128 are also interposed the sheet material 12 and its respective cam follower 112 to mechanically prevent its respective tool from overrunning its predetermined sheet material stop position.

While in actuality, cams 122 and 124 may rotate in one direction while cams 126 and 128 rotate in the opposite direction, all of the cams are shown as rotating in a clockwise direction in FIGS. 4–8 for the sake of clarity. Also, the relative angular position of each cam is indicated by an arrow 136 in FIG. 6.

As indicated in FIG. 7, the profile of each cam 122, 124, 126, 128 has a lowering transition portion 138 between the lobe and null portions 134, 132 on one side of the cams and a raising transition portion 140 between the lobe and null portions on the other side. The terminus of the lowering transition portion 138 with the lobe portion 134 of each cam provides a first or end of lobe point 142, while its terminus with the null portion 132 provides a second or start of null point 144. Likewise, the terminus of the raising transition portion 140 with the null portion 132 provides a third or end of null point 146, while its terminus with the lobe portion 134 provides a fourth or start of lobe point 148.

Figure 9:
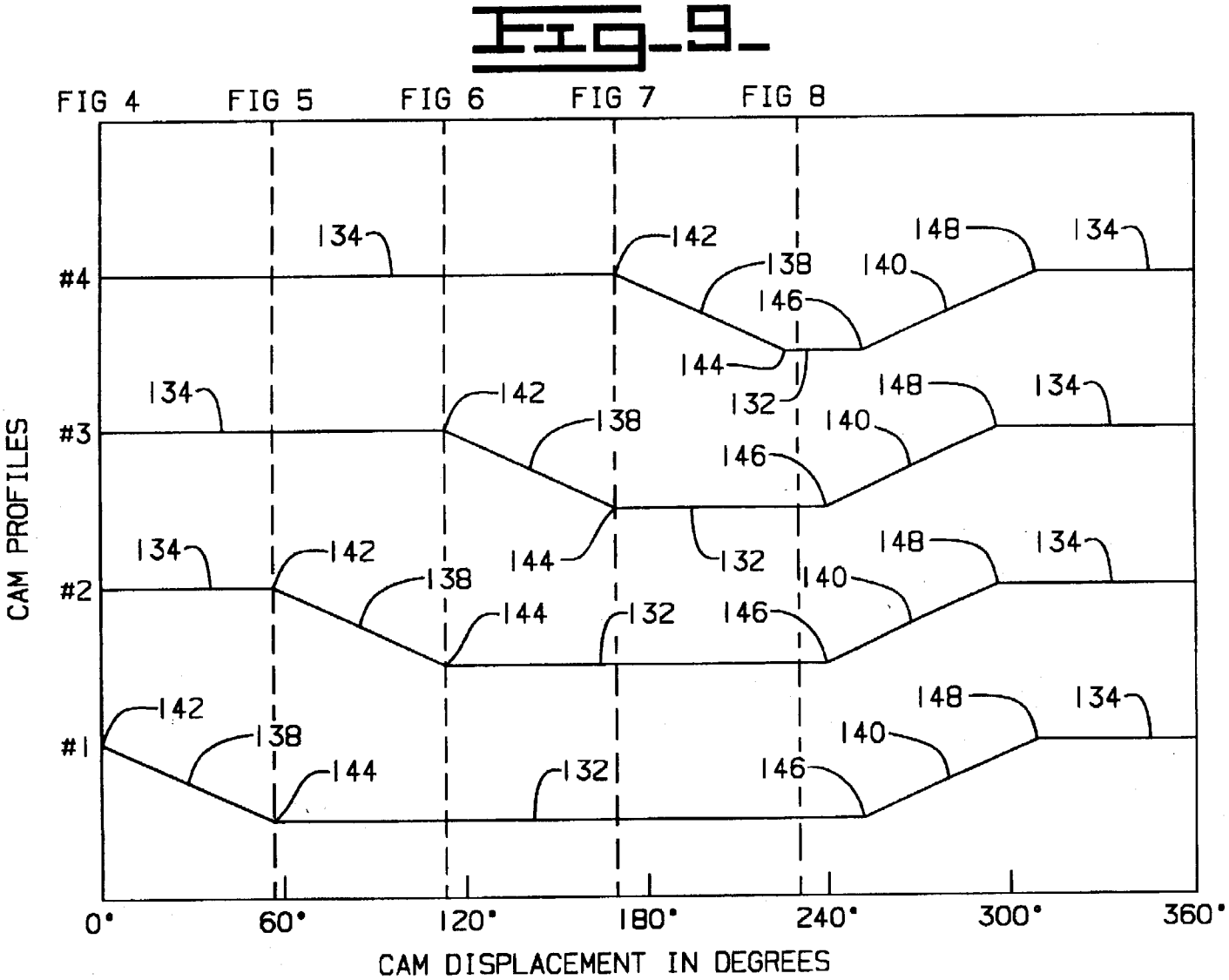
FIG. 9 is graph illustrating cam displacement in degrees of rotation for the four cams and their relative cam profiles.

The profiles of the cams 122, 124, 126 and 128 are graphically illustrated in FIG. 9 and numbered as cam profiles #1, #2, #3 and #4, respectively. In FIG. 9, it can readily be seen that end of lobe point 142 for cam profile #1 of cam 122 is located at 0 degrees of cam displacement and transcends downward along the lowering transition portion 138 to the start of null point 144 at approximately 60 degrees of displacement. From there, the profile of cam 122 proceeds along the null portion 132 until reaching the end of null point 146 after approximately 250 degrees of displacement. The profile then proceeds up the raising transition portion 140 to the start of lobe point 148, and then along the lobe portion 134 to the starting point at 0 degrees. The end of lobe point 142 for cam profile #2 is generally coincident to the start of null point 144 for cam profile #1, delaying its lowering transition portion 138 relative to cam profile #1. Likewise, the lowering transition portions 138 of cam profiles #3 and #4 are sequentially delayed, as can be seen in FIG. 9, to actuate the cams 122, 124, 126 and 128 in a sequential fashion. All of the raising transition portions could be coincident to each other. However, the raising transition portions 140 of cam profiles #2 and #3 preferably precede those of cam profiles #1 and #4 to allow for smoother operation of the machine 10.

With this arrangement, starting with all of the tools 32, 34, 36, and 38 in their clearance position shown in FIG. 4, the first or upper clamping tool 32 will be the first to move to its sheet material stop position, followed closely by movement of the second or lower clamping tool 34 to its stop position, which is then followed by the first or upper forming tool 36 and lastly by the second or lower forming tool 38 to their respective stop positions. After all of the tools 32, 34, 36, and 38 reach their stop positions, the lower clamping tool 34 and the upper forming tool 36 will return together to their clearance positions, followed closely by the upper clamping tool 32 and the lower forming tool 38.

As shown in FIGS. 1 and 2, the fin folding machine 10 is also provided with a material feeder 168 for intermittently feeding a preselected length of the sheet metal material 12 in a first direction as indicated by the arrow 170, into the opening 22 of the fin folding machine 10. The feeder 168 is adapted to permit unrestricted travel of the material 12 in the first direction 170, but prevents the travel of the material in an opposite direction.

A drive system 174, shown in FIG. 1, includes an electric motor 176 and a drive train 178 adapted to be driven by the motor and is provided for rotatably driving each of the cams 122, 124, 126, and 128 that are rotatably mounted in side support member 24. A similar gear train 178, not shown, is provided on the opposite side support member 26 to drive the cams 122, 124, 126, and 128 mounted therein in a similar fashion. The motor 176 is drivingly connected to a main cross shaft 192 by a drive belt 194. The cross shaft 192 extends between the side support members 24. As shown in FIG. 1, the cross shaft 192 has a spur gear 196 that meshes with an idler gear 198 that is rotatably mounted to the side support member 24. The idler gear 198, in turn, is meshed with a spur gear 200 for the second cam 124. The spur gear 200 for the second cam 124, in turn, is meshed with a spur gear 202 for the fourth cam 128. An idler gear 204 is rotatably mounted to the side support member 24 and is used to transfer the driving motion of the spur gear 202 for the fourth cam 128 to a spur gear 206 for the third cam 126. The spur gear 206 for the third cam 126 is, in turn, meshed with a spur gear 208 for the first cam 122. A common shaft 190 is used to connect each of the spur gears 200, 202, 206 and 208 to its respective cams 124, 128, 126 and 122.

A control system 210 is provided for controlling the material feeder 168 when the drive system 174 is in operation. The control system 210 includes a controller 212 and a sensor 214. The sensor 214 is adapted to sense the angular position of the camming devices 102, 104, 106, and 108 and to deliver a control signal to the controller 212. The controller 212 is adapted to actuate the material feeder 168 in response to the control signal to cause the material feeder 168 to advance the sheet material 12 when the clamping and forming tools 32, 34, 36, and 38 are all in their respective clearance positions.

As best shown in FIG. 3, the fin folding machine 10 further includes an inlet guide 224 for guiding the sheet material 12 along the predetermined path 18 toward the clamping and forming tools 32, 34, 36, and 38 and an outlet guide 226 for guiding the corrugated material 14 along the path away from the clamping and forming tools. As shown in FIG. 1, a take-up reel stand 228 is also preferably provided for receiving the corrugated material 14 from the fin folding machine 10.

Industrial Applicability

The fin folding machine 10 constructed in accordance with the teachings of the present invention advantageously forms thin sheet metal material 12 into high aspect ratio, serpentine corrugations 14 suitable for use as the primary surface plates of heat exchangers or recuperators at a higher forming speed than heretofore possible. Such higher forming speed is made possible by the use of cams 122, 124, 126, and 128 and accumulators 96, 98. The high pressure accumulators 96, 98 are effective in keeping the cam followers 112 for the forming and clamping tools 32, 34, 36, and 38 in continuous contact with the cams 122, 124, 126 and 128, while the location of the cams on the inside of the cam followers 11 provide a physical stop and prevent the forming and clamping tools 32, 34, 36, and 38 from overshooting the desired forming or clamping positions, regardless of the speed of the forming operation. As a consequence, more precisely formed corrugations 14 are obtainable at higher forming rates, thus increasing production, while reducing the amount of scrap due to misformed material.

Because the clamping and forming tools 32, 34, 36, and 38 move in a linear, rather than an arcuate, path, the present fin folding machine 10 also improves the life of the knife blades 56, 60, and 62 used in the clamping and forming tools 32, 34 and 36. This is because the amount of sliding movement between the sheet material 12 and the sides of the blades 56, 60, and 62 and the amount of bending loads on the blades are reduced. As a consequence, the blades 56, 60, and 62 do not wear out as fast, nor do they break as often.

Other aspects, objects and advantages of the present invention can be obtained for a study of the drawings, the disclosure and the appended claims.

What is claimed is:

1. A fin folding machine for sequentially folding relatively thin sheet metal material into narrowly grooved corrugations, comprising:

a pair of opposed clamping tools disposed on opposite sides of said sheet material, said clamping tools being movable in a direction transverse to and into engagement with said sheet material to clamp said sheet material therebetween;

a pair of opposed forming tools disposed on opposite sides of said sheet material, said forming tools being sequentially movable in a direction transverse to and into engagement with said sheet material to fold said sheet material in one direction by the engagement of one of said forming tools and then in the opposite direction by the engagement of the other of said forming tools;

an accumulator system for applying a substantially continuous force on each of said clamping and forming tools to urge each of said tools into engagement with said sheet material; and at least four camming devices, each of said camming devices being adapted to overcome said accumulator force and to move a respective one of said clamping and forming tools away from engagement with said sheet material to a clearance position, and to prevent its respective clamping or forming tool from exceeding a predetermined sheet material engagement stop position regardless of the operating speed of said fin folding machine.

2. The fin folding machine of claim 1 including:

a feeder for intermittently feeding a preselected length of said sheet metal material in a first direction into said folding machine, and permitting unrestricted travel of said material in said first direction, but preventing the travel of said material in an opposite direction.

3. The fin folding machine of claim 2 including:

a drive system for rotatably driving each of said cams; and a control system for controlling said feeder in response to said drive system.

4. The fin folding machine of claim 3 wherein said drive system includes an electric motor and a drive train adapted to be driven by said motor, said drive train including at least one set of intermeshed spurs gears, including a spur gear for each of said cams.

5. The fin folding machine of claim 4 wherein said drive train includes a plurality of shafts including a common shaft for each cam and its associated spur gear.

6. The fin folding machine of claim 5 wherein said control system includes a controller and a sensor, said sensor being adapted to sense the angular position of said camming devices and to deliver a control signal to said controller, and said controller being adapted to actuate said feeder in response to said control signal to cause said feeder to advance said sheet material when said clamping and forming tools are all in their respective clearance positions.

7. The fin folding machine of claim 1 including a frame structure having an opening therethrough defined by a pair of upright side support members, a top support member between the upper ends of the side support members and a base support member between the lower ends of the side support members.

8. The fin folding machine of claim 7 wherein each of said clamping and forming tools includes an elongated plate, a tool holder attached to one end of its respective plate, and a tool attached to said tool holder.

9. The fin folding machine of claim 8 including:

linear bearing means for reciprocatably mounting each of said elongated plates to said frame structure for movement of each plate along a linear path transverse to said sheet material.

10. The fin folding machine of claim 8 wherein each of said elongated plates are oriented transversely between said side support members of said frame structure and each has one end adjacent one of said side support members and an opposite end adjacent the other of said side support members, and wherein each of said camming devices includes a pair of cam followers and a pair of cams for each of said clamping tools and said forming tools, each cam follower being rotatably carried on one of the respective ends of a respective one of said plates and each cam being rotatably carried on an adjacent one of said side support members.

11. The fin folding machine of claim 10 wherein each of said cams has a null portion and a lifting lobe portion thereon, said lifting lobe portion being adapted to lift its respective tool to said sheet material clearance position, and said null portion being adapted to permit its respective tool to assume its predetermined sheet material engagement stop position, and being interposed said sheet material and its respective cam follower to prevent its respective tool from overrunning its predetermined sheet material stop position.

12. The fin folding machine of claim 11 wherein said pairs of cams includes a first pair of cams for operating a first one of said clamping tools, a second pair of cams for operating a second one of said clamping tools, a third pair of cams for operating a first one of said forming tools, and a fourth pair of cams for operating a second one of said forming tools, and wherein each of said pairs of cams have a cam profile with a predetermined end of lobe point, start of null point, end of null point and start of lobe point.

13. The fin folding machine of claim 12 wherein each of said elongated plates of said clamping and forming tools has an end adjacent a respective one of said top support member and said base support member, and wherein said accumulator system includes a pair of nitrogen gas cylinders for each of said clamping and forming tools, each pair being mounted between a respective one of said top support member and said base support member and the adjacent end of their respective elongated plates, each gas cylinder being charged to a substantial gas pressure sufficient to cause the clamping tools to clamp the sheet material therebetween and each of the forming tools to fold such sheet material.

14. The fin folding machine of claim 13 wherein said nitrogen gas cylinders have a gas charge pressure of approximately 15,000 p.s.i.

15. The fin folding machine of claim 1 including:

an inlet guide for guiding said sheet material along a predetermined path toward said clamping and forming tools; and an outlet guide for guiding said sheet material along said path away from said clamping and forming tools.

* * * * *